US006585624B1

(12) United States Patent
Chen

(10) Patent No.: US 6,585,624 B1
(45) Date of Patent: Jul. 1, 2003

(54) RUNNING EXERCISER STRUCTURE

(75) Inventor: Yen-Huang Chen, No. 10-1, Lane 181, Chen Ping Rd., Pei-Tun District, Taichung (TW)

(73) Assignees: Alilife Industrial Co., Ltd., Taichung Hsien (TW); Yen-Huang Chen, Taichung (TW)

( * ) Notice: Subject to any disclaimer, the term of this patent is extended or adjusted under 35 U.S.C. 154(b) by 0 days.

(21) Appl. No.: 10/067,752

(22) Filed: Feb. 8, 2002

(51) Int. Cl.[7] ..... A63B 22/02
(52) U.S. Cl. ..... 482/54; 482/51
(58) Field of Search ..... 482/51, 54; 248/188.1, 248/639

(56) References Cited

U.S. PATENT DOCUMENTS 5,184,988 A * 2/1993 Dunham ..... 482/54
5,626,538 A * 5/1997 Dalebout et al. ..... 482/54
6,273,842 B1 * 8/2001 Wang et al. ..... 482/54
6,325,745 B1 * 12/2001 Yu ..... 482/54

* cited by examiner

*Primary Examiner*—Stephen R. Crow
(74) *Attorney, Agent, or Firm*—Rosenberg, Klein & Lee

(57) ABSTRACT

A running exerciser structure, a front end of the running board frame is pivotally connected with a second board of a linking mechanism. When a driving motor of the linking mechanism drive a threaded rod to forward or backward rotate, a first and a second threaded bushes are moved along the threaded rod opposite to each other. At the same time, a first and a third links and a third and a fourth links are driven to move opposite to each other. The second board can be continuously ascended or descended and the running board frame is upward or downward inclined to form an upward slope, a downward slope or a plane face. Therefore, a user can upgrade or downgrade or horizontally run on the running board to exercise his/her body to different extents.

3 Claims, 13 Drawing Sheets

RUNNING EXERCISER STRUCTURE

BACKGROUND OF THE INVENTION

The present invention is related to a running exerciser structure. The running board frame of the running exerciser can be upward or downward inclined to form an upward slope, a downward slope or a plane face. Therefore, a user can upgrade or downgrade or horizontally run on the running board to exercise his/her body to different extents.

FIGS. 10 and 11 show a conventional running exerciser including a base seat 50 and a running board frame 51 pivotally mounted on the base seat 50. Opposite caster supports 52 are pivotally mounted on rear end of the running board frame 51. A linking mechanism (not shown) is drivingly connected between the caster supports 52 and the base seat 50. The linking mechanism via a motor (not shown) is pivotally mounted on the base seat 50. The motor serves to drive a threaded rod (not shown).

The motor drives the threaded rod to operate the caster supports 52 at rear end of the running board frame 51 and thus slightly change the inclination thereof. Such function is simple and the running exerciser can hardly provide advanced exercising effect for a user.

FIGS. 12 and 13 show another type of conventional running exerciser. A support leg 601 is disposed on one side of the base seat 60. An upright column 61 is disposed on the other side of the base seat 60. A cylinder 62 is mounted on the bottom of the upright column 61. The cylinder 62 has a stem 621 connected with one end of a first link 63. The other end of the first link 63 is pivotally connected with a second link 64 on a pivot section 651 under the running board 65. The other end of the second link 64 is pivotally connected with the base seat 60 on a pivot section. The stem 621 of the cylinder 62 can extend to push the first link 63 and make the running board 65 pivot on the pivot section connecting the second link 64 with the base seat 60. Accordingly, the front side of the running board 65 can be lifted to adjust the inclination thereof. Therefore, the running board 65 can be adjusted into an upward slope or a plane face for training a user. Such function is still simple and the running exerciser cannot achieve advanced exercising effect.

SUMMARY OF THE INVENTION

It is therefore a primary object of the present invention to provide a running exerciser structure. A front end of the running board frame is pivotally connected with a second board of a linking mechanism. When a driving motor of the linking mechanism drive a threaded rod to forward or backward rotate, a first and a second threaded bushes are moved along the threaded rod opposite to each other. At the same time, a first and a third links and a second and a fourth links are driven to move opposite to each other. The second board can be continuously ascended or descended and the running board frame is upward or downward inclined to form an upward slope, a downward slope or a plane face. Therefore, a user can upgrade or downgrade or horizontally run on the running board to exercise his/her body to different extents.

The present invention can be best understood through the following description and accompanying drawings wherein:

DETAILED DESCRIPTION OF THE PREFERRED EMBODIMENTS

Figure 1:
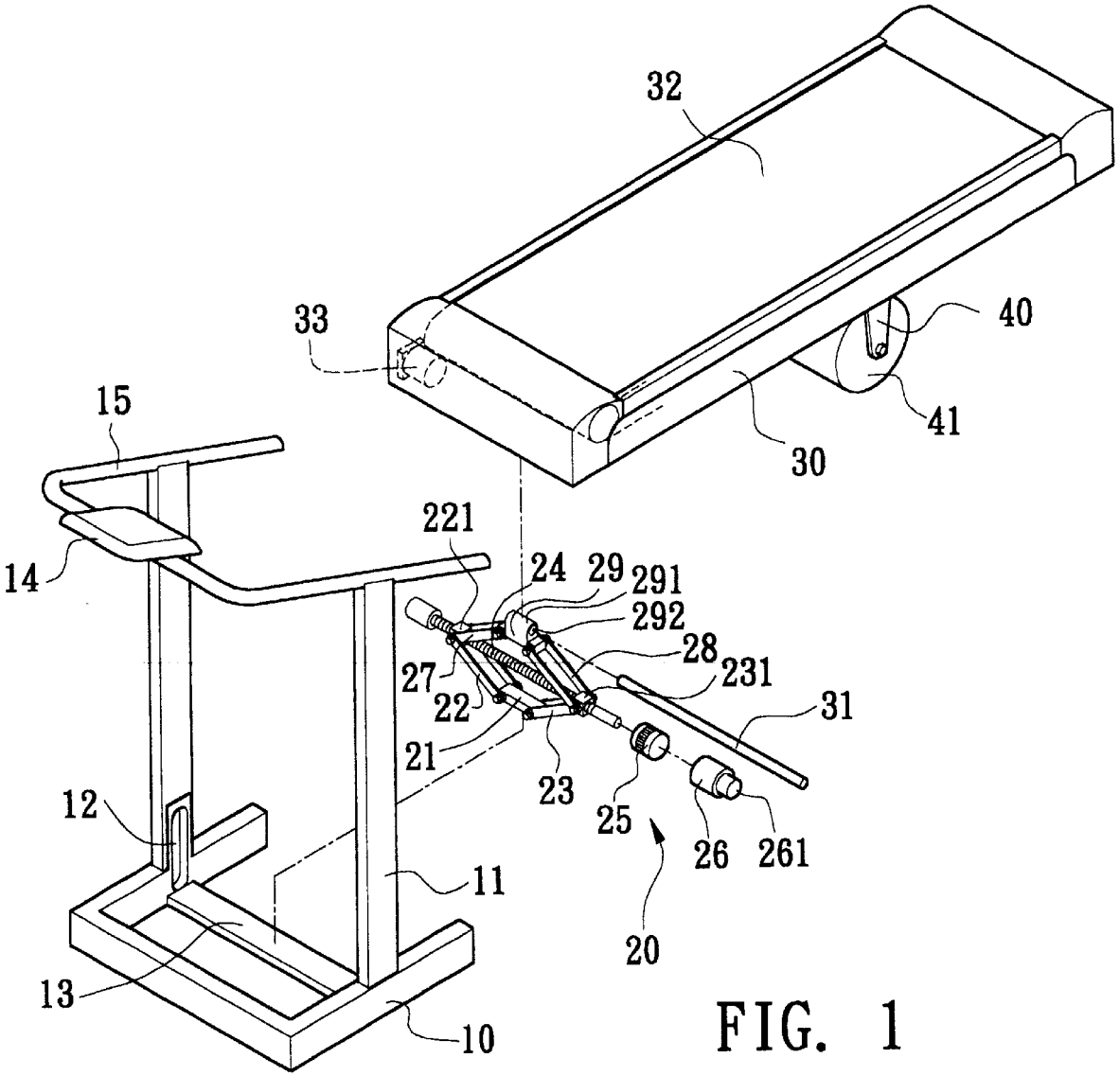
FIG. 1 is a perspective exploded view of the present invention.
Figure 2:
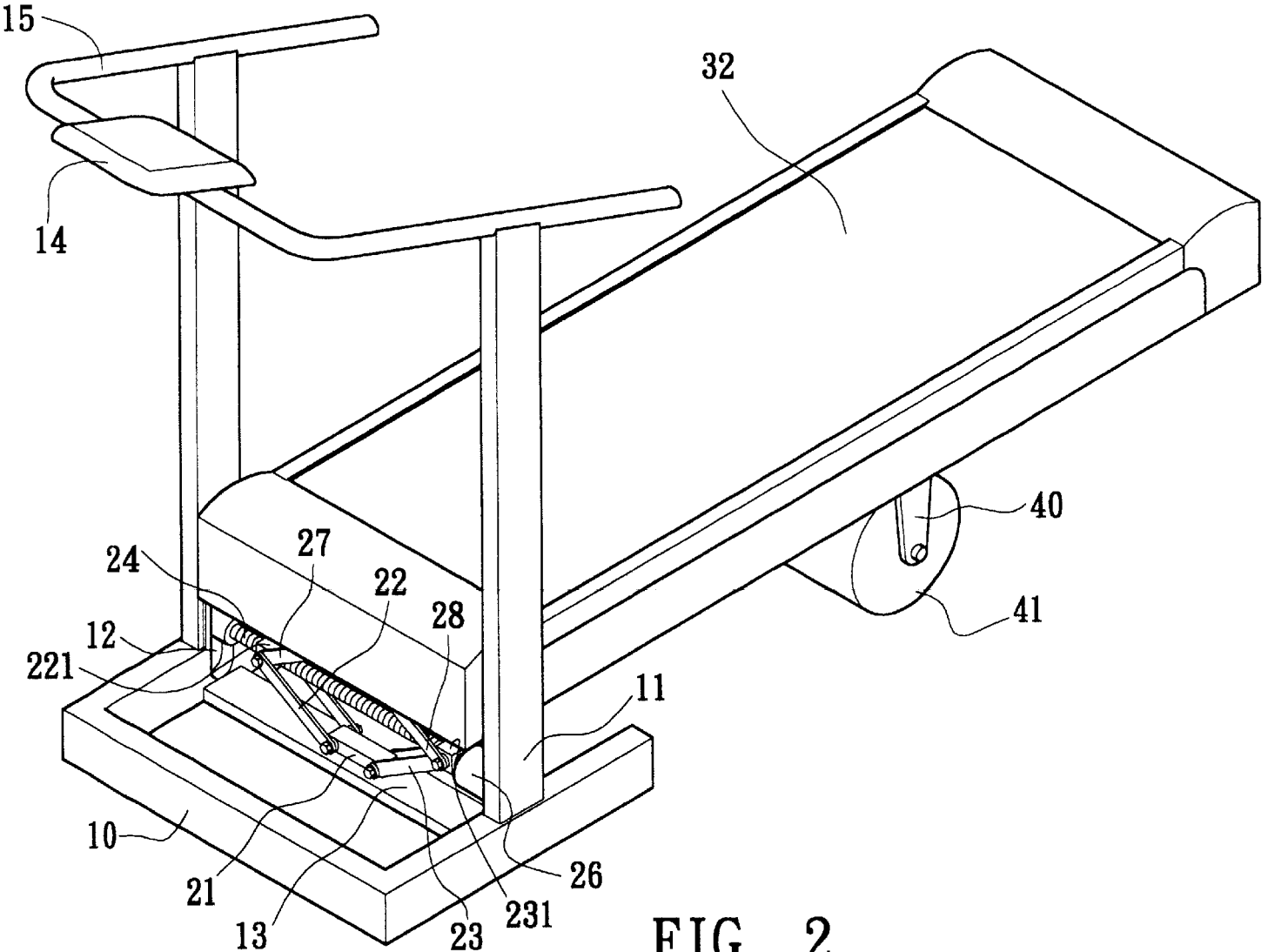
FIG. 2 is a perspective assembled view of the present invention.
Figure 3:
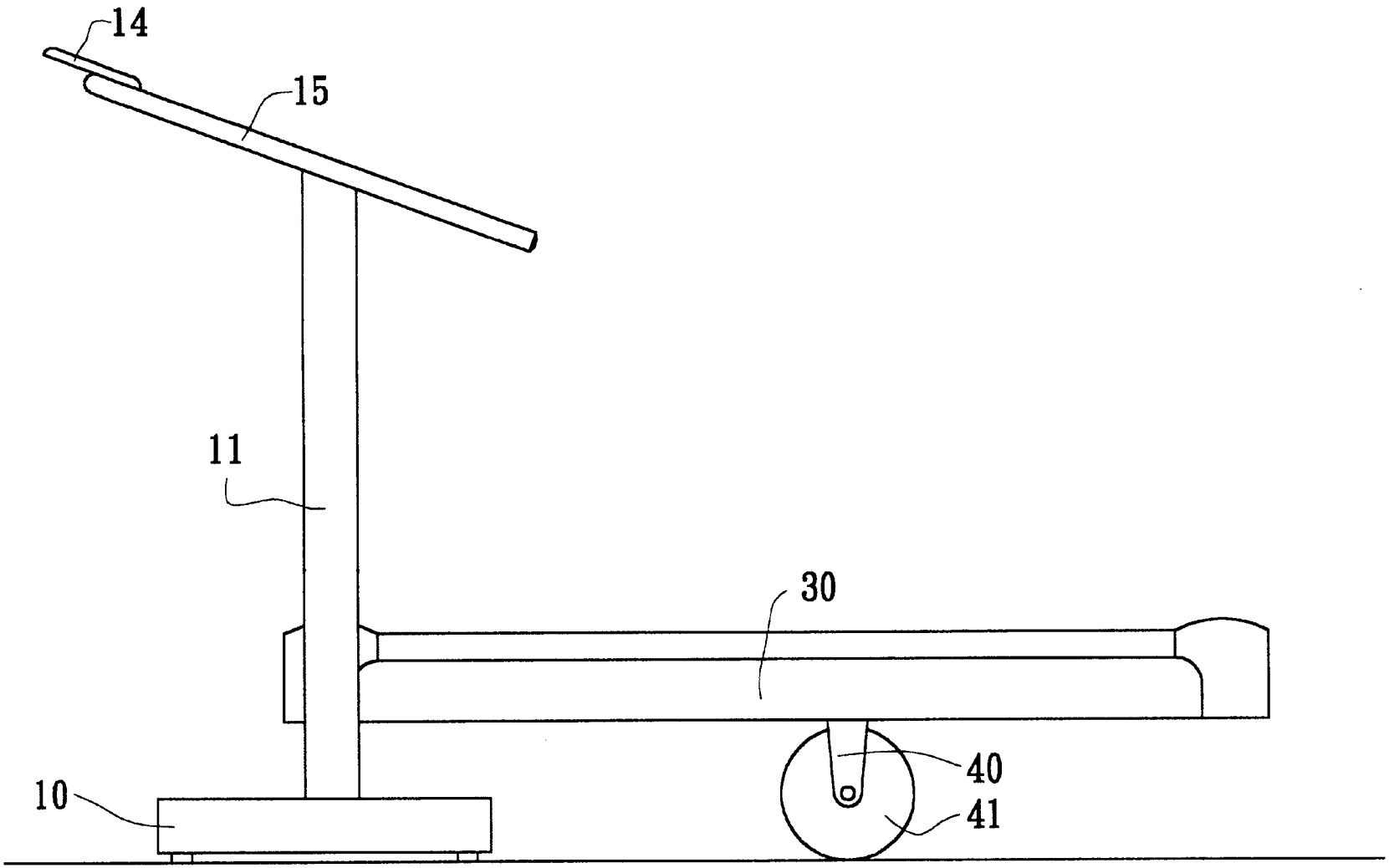
FIG. 3 is a side assembled view of the present invention.
Figure 4:
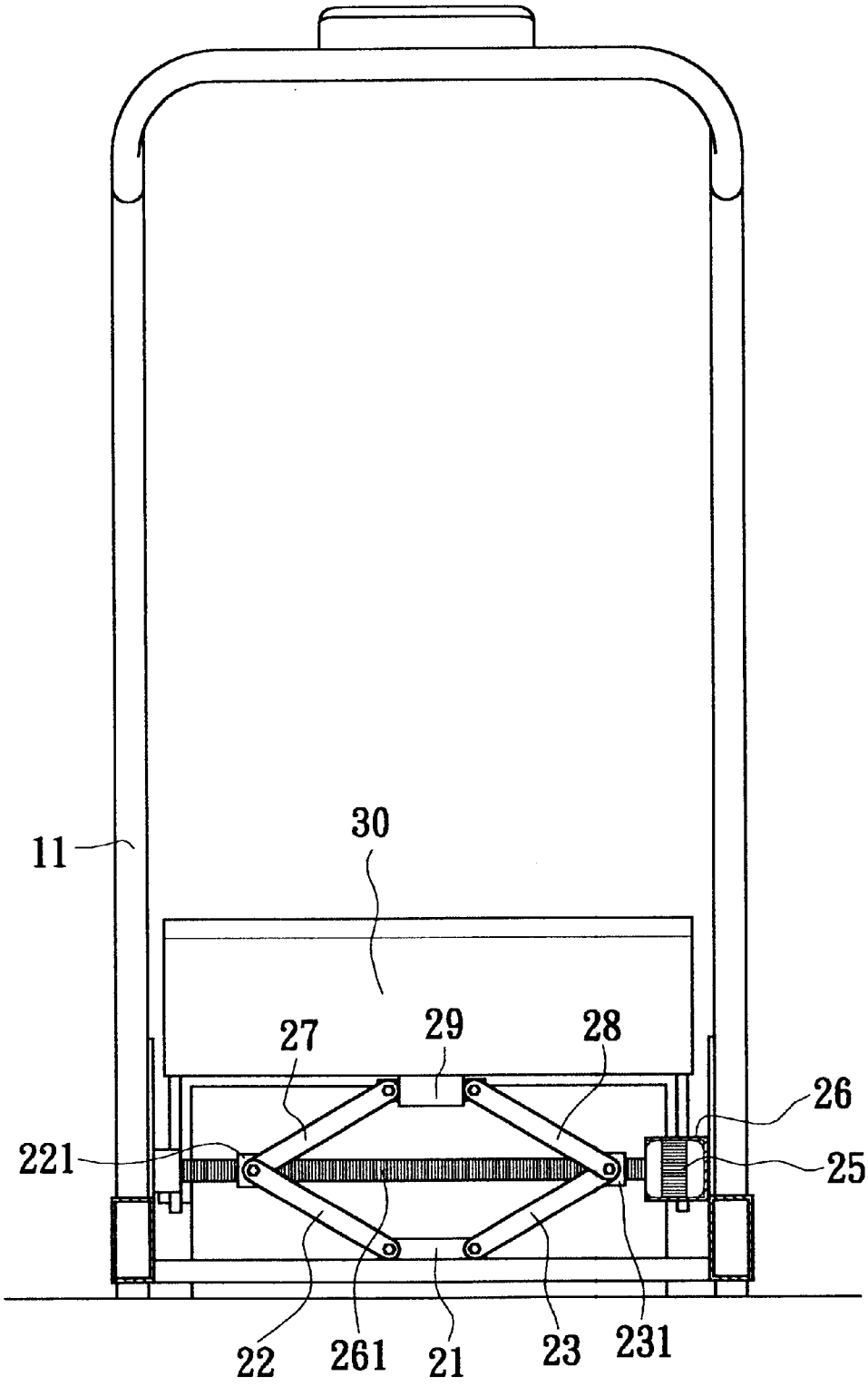
FIG. 4 is a front assembled view of the present invention.

Please refer to FIGS. 1 to 4. The running exerciser structure of the present invention includes a base seat 10, a linking mechanism 20, a running board frame 30 and a supporting device.

The base seat 10 has two upright columns 11 respectively disposed on two sides of the base seat 10. The opposite inner sides of the two upright columns 11 are respectively formed with two longitudinal guide channels 12. A connecting board 13 is connected between the two upright columns 11 in the base seat 10. A rail 15 having a controller 14 is disposed between top ends of the two upright columns 11.

In this embodiment, the linking mechanism 20 has a first board 21 fixed on the connecting board 13 of the base seat 10. A first link 22 and a second link 23 are respectively pivotally connected with two ends of the first board 21. Two opposite ends of the first and second links 22, 23 distal from the first board 21 are respectively pivotally connected with a first threaded bush 221 and a second threaded bush 231 which respectively have a first and a second thread holes 222, 232. A threaded rod 24 is screwed through the thread holes 222, 232. A driving motor 25 is disposed at one end of the threaded rod 24. A cover body 26 is fitted around the driving motor 25. The cover body 26 has a projecting post 261 on one side. The projecting post 261 is received in the guide channel 12 of the upright column 11. One end of the threaded rod 24 is received in the guide channel 12 of the other upright column 11. The driving motor 25 serves to drive the threaded rod 24 to rotate, whereby the first and second threaded bushes 221, 231 can move along the threaded rod 24 opposite to each other. At the same time, the threaded rod 24 is moved up and down within and along the guide channels 12 of the upright columns 11.

The first and second links 22, 23 are respectively pivotally connected with a third link 27 and a fourth link 28. The other ends of the third and fourth links 27, 28 are pivotally connected with a second board 29, whereby the first, second, third and fourth links 22, 23, 27, 28 form a four-link mechanism. A pivot section 291 is disposed on the second board 29. The pivot section 291 is formed with a through hole 292.

The running board frame 30 is a rectangular frame composed of four beams. One side of the running board frame 30 is pivotally connected with the second board 29 via a pivot shaft 31 fitted in the through hole 292 of the second board 29. A running board (not shown) is disposed on the running board frame 30. A running belt 32 is wound around the running board and driven by a running belt motor 33 to revolve around the running board.

The supporting device is disposed under the middle of the running board frame 30. In this embodiment, the supporting device is fixed under the middle of the running board frame 30 via two lugs 40. A supporting wheel 41 is pivotally connected between the two lugs 40 for supporting the running board frame 30.

Figure 5:
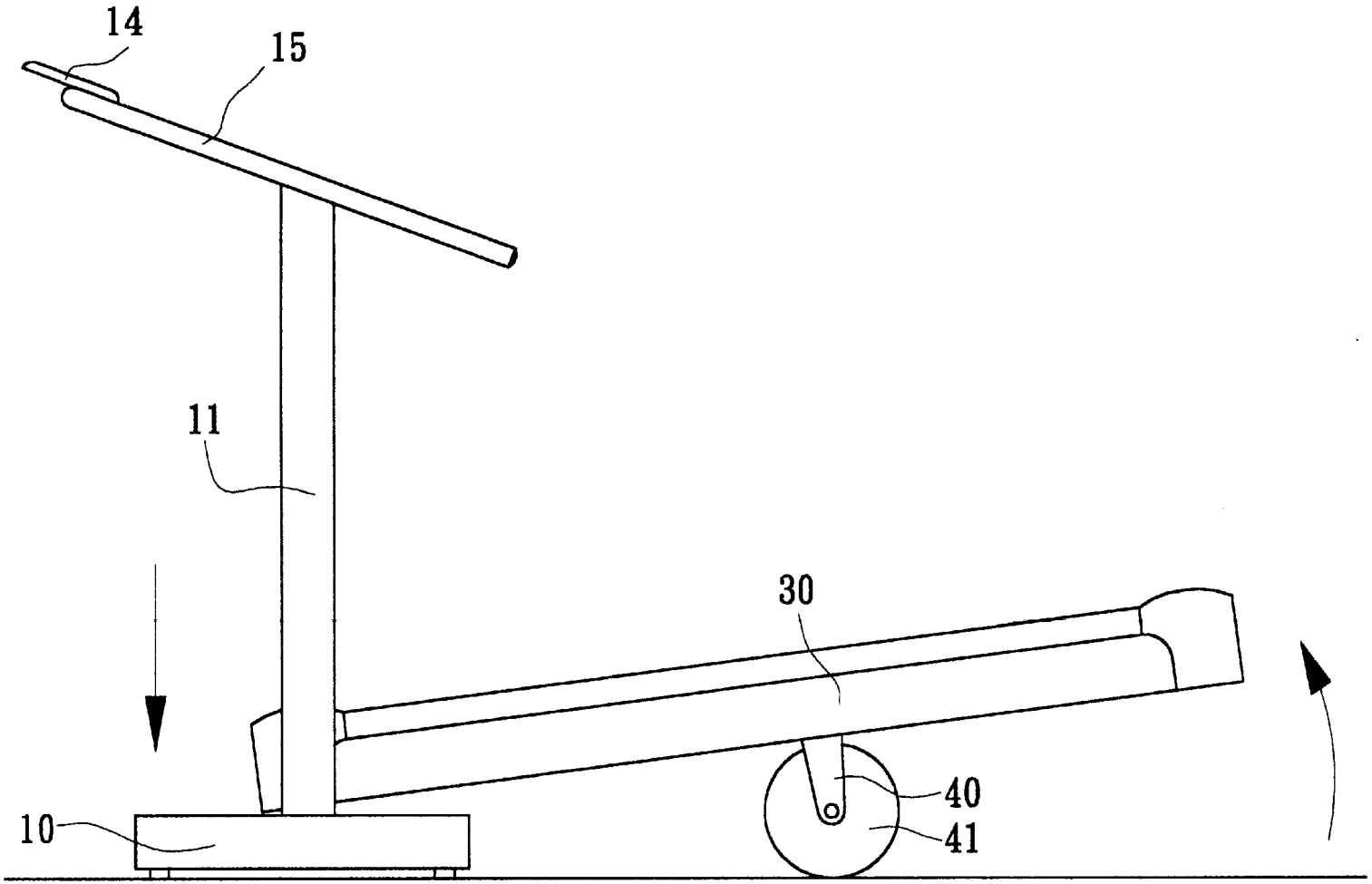
FIG. 5 shows that the front end of the running board frame of the present invention is declined.
Figure 6:
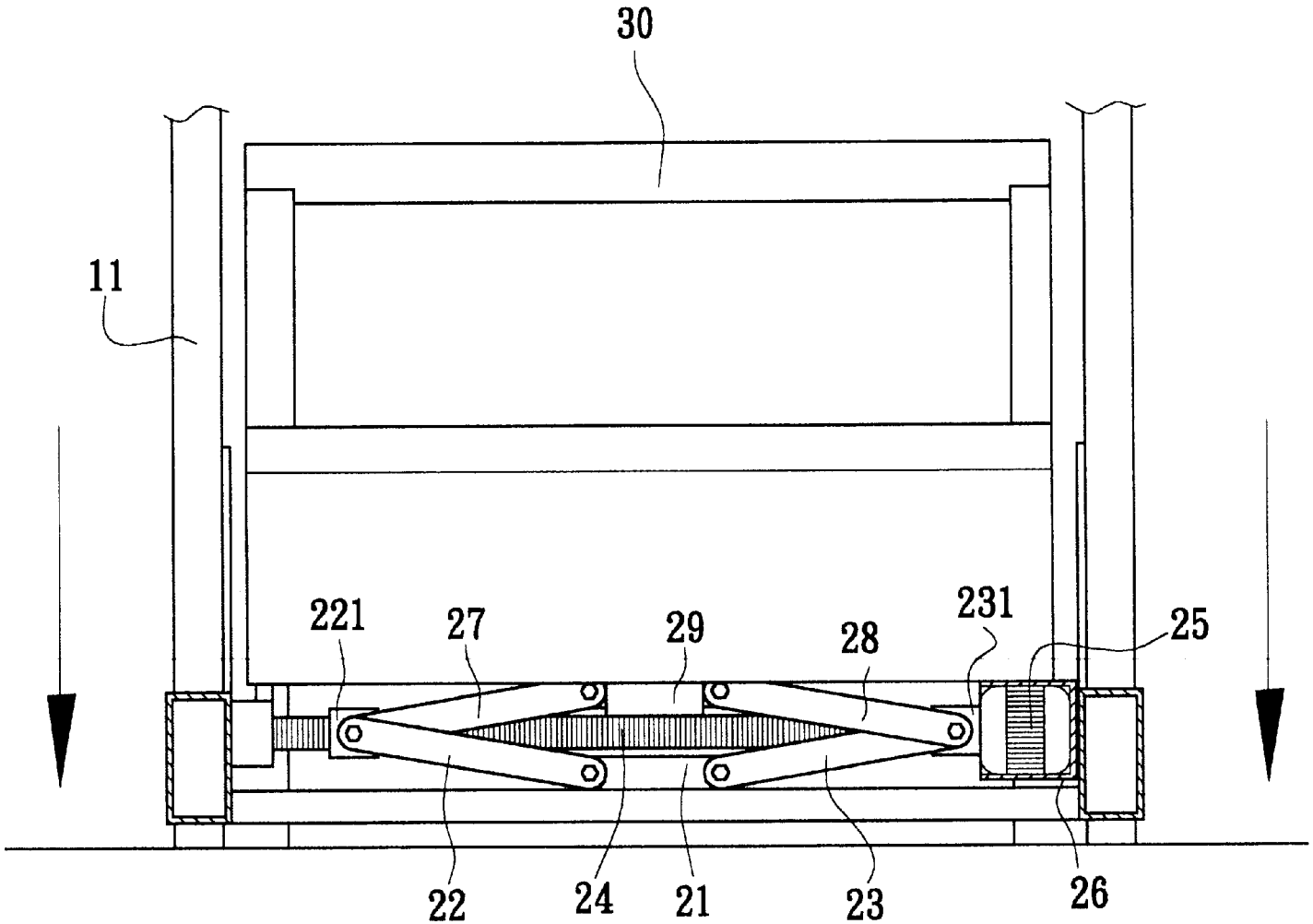
FIG. 6 shows that the linking mechanism of the present invention operates to decline the front end of the running board frame.

Referring to FIGS. 5 and 6, a user can press a press button (not shown) of the controller 13 to make the running belt motor 33 drive the running belt 32 to revolve around the running board. The user can run on the running belt 32 for exercise. In addition, the user can press a running board controlling button (not shown) of the controller 13 to make the driving motor 25 of the linking mechanism 20 drive the threaded rod 24 to backward rotate. At this time, the first and second threaded bushes 221, 231 are moved along the threaded rod 24 away from each other. The first threaded bush 221 drives the first link 22 and the third link 27 to move outward, while the second threaded bush 231 drives the second link 23 and the fourth link 28 to move outward, whereby the second board 29 is descended. Accordingly, with the supporting wheel 41 serving as a fulcrum, the running board frame 30 is declined and the front end of the running board frame 30 is descended. At this time, one end of the threaded rod 24 and the projecting post 261 of the cover body 26 are moved downward along the guide channels 12 of the upright columns 11. Accordingly, the front side of the running board frame 30 is descended to serve as a downward slope for the user to run thereon and exercise.

Figure 7:
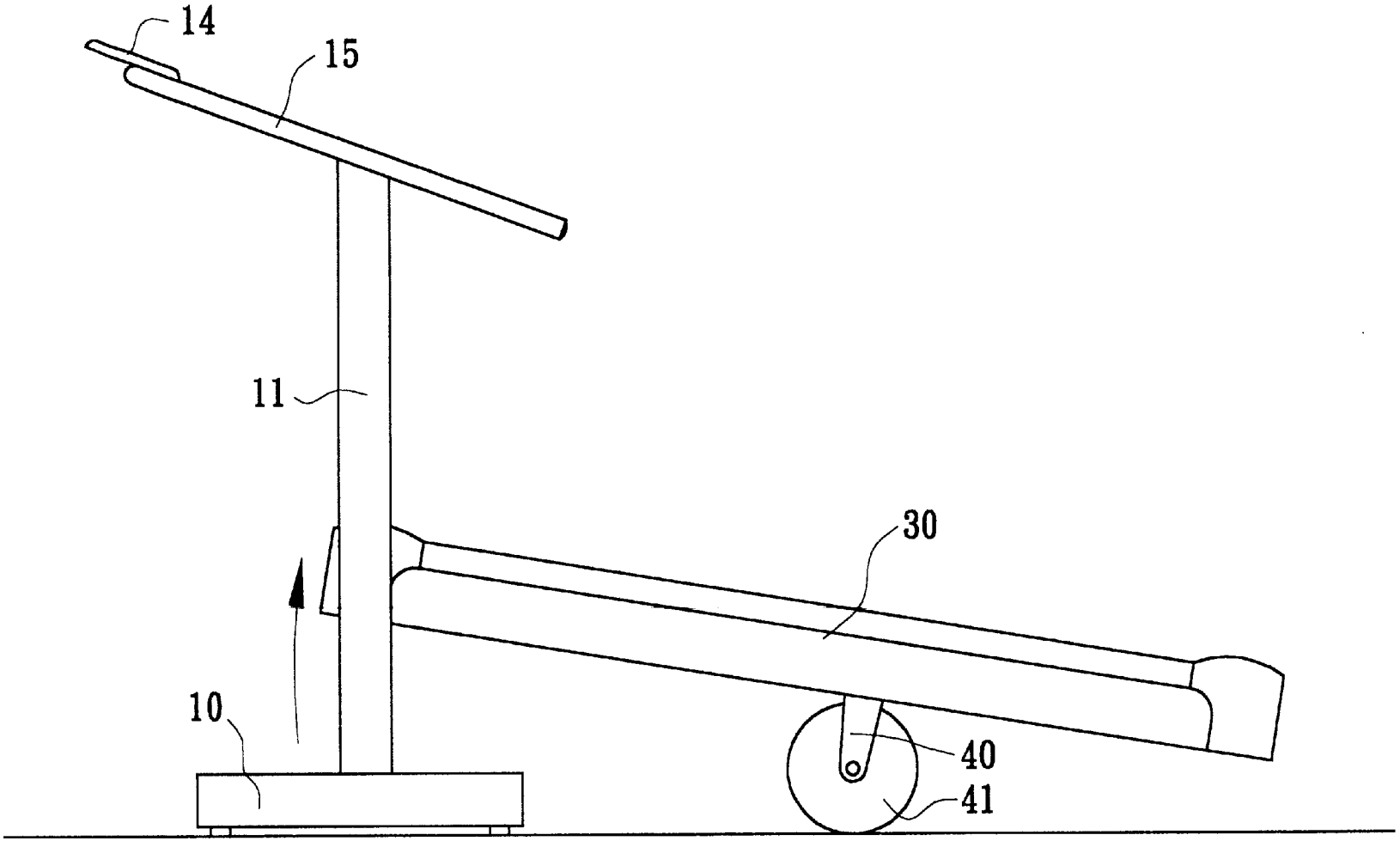
FIG. 7 shows that the front end of the running board frame of the present invention is upward inclined.
Figure 8:
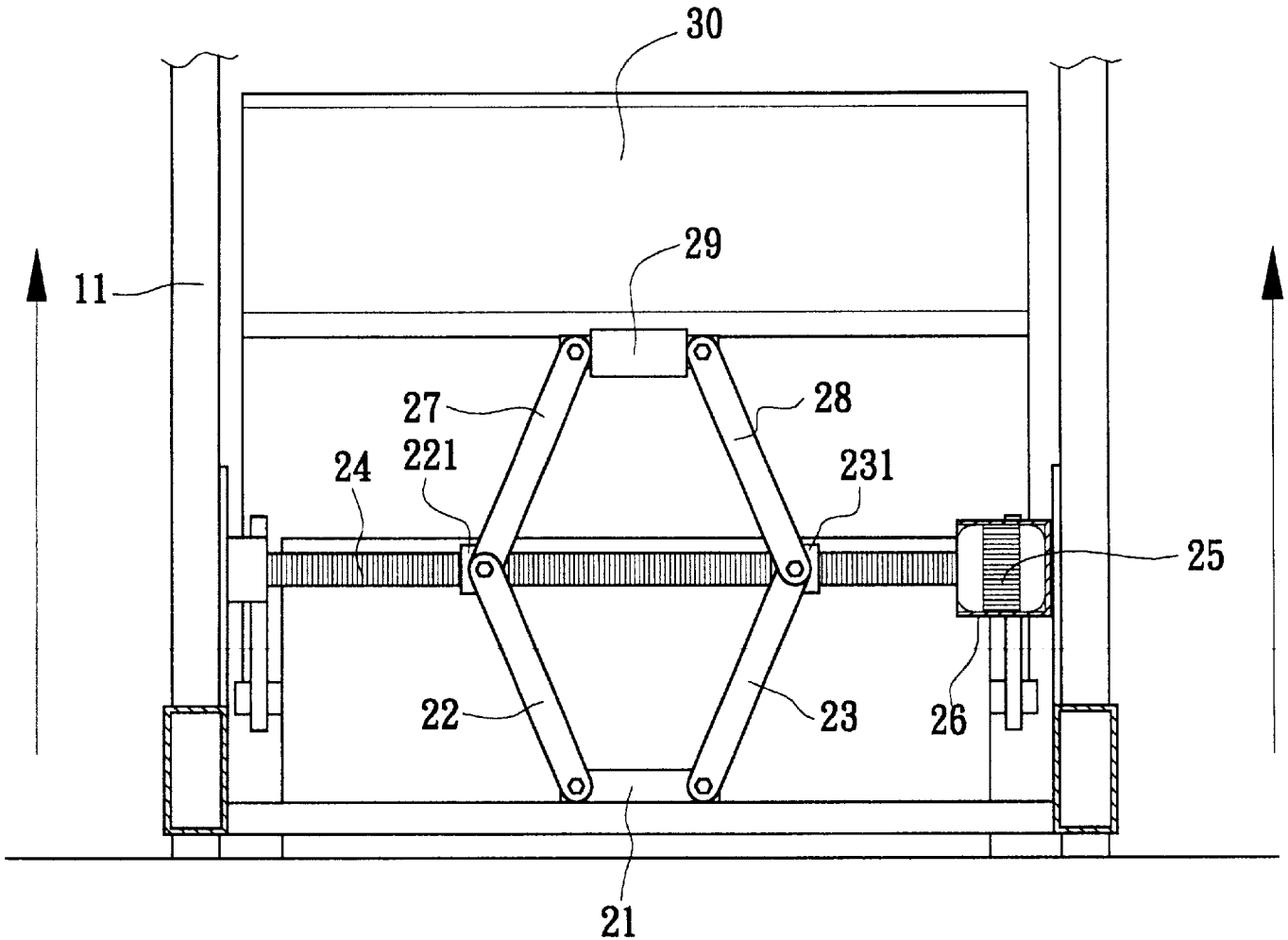
FIG. 8 shows that the linking mechanism of the present invention operates to upward incline the front end of the running board frame.

Referring to FIGS. 7 and 8, the user can press a running board controlling button (not shown) of the controller 13 to make the driving motor 25 of the linking mechanism 20 drive the threaded rod 24 to forward rotate. At this time, the first and second threaded bushes 221, 231 are moved along the threaded rod 24 toward each other. The first threaded bush 221 drives the first link 22 and the third link 27 to move inward, while the second threaded bush 231 drives the second link 23 and the fourth link 28 to move inward, whereby the second board 29 is ascended. Accordingly, with the supporting wheel 41 serving as a fulcrum, the running board frame 30 is upward inclined and the front end of the running board frame 30 is ascended. At this time, one end of the threaded rod 24 and the projecting post 261 of the cover body 26 are moved upward along the guide channels 12 of the upright columns 11. Accordingly, the front side of the running board frame 30 is ascended to serve as an upward slope for the user to run thereon and exercise.

The driving motor 25 is able to drive the threaded rod 24 to forward and backward rotate, whereby the running board frame 30 can be continuously upward or downward inclined by a certain angle to form an upward slope, a downward slope or a plane face. Therefore, a user can upgrade or downgrade or horizontally run on the running board to exercise his/her body to different extents.

Figure 9:
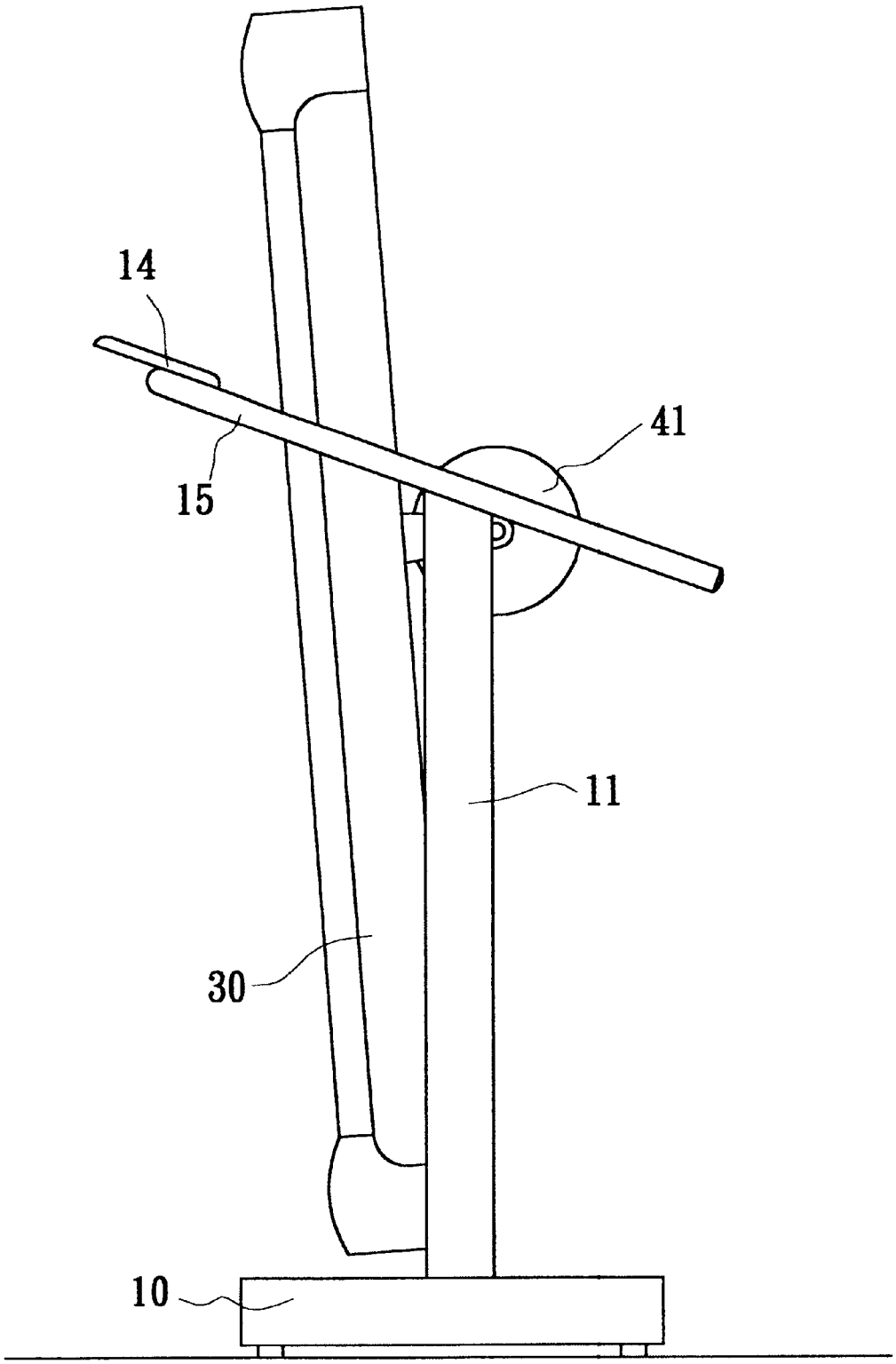
FIG. 9 shows that the running board frame of the present invention is manually folded.
Figure 10:
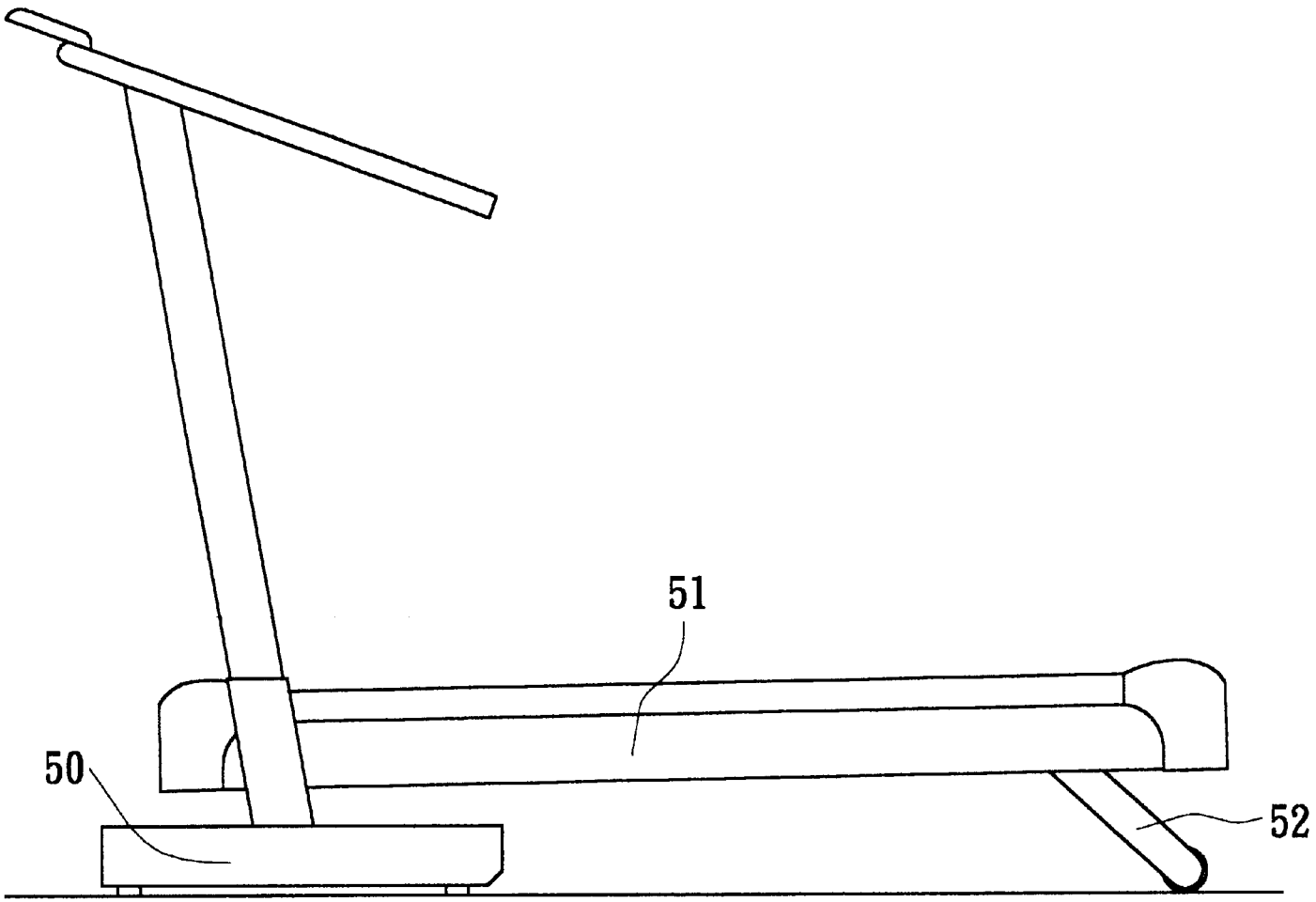
PRIOR ART FIG. 10
FIG. 10 is a side assembled view of a conventional running exerciser.
Figure 11:
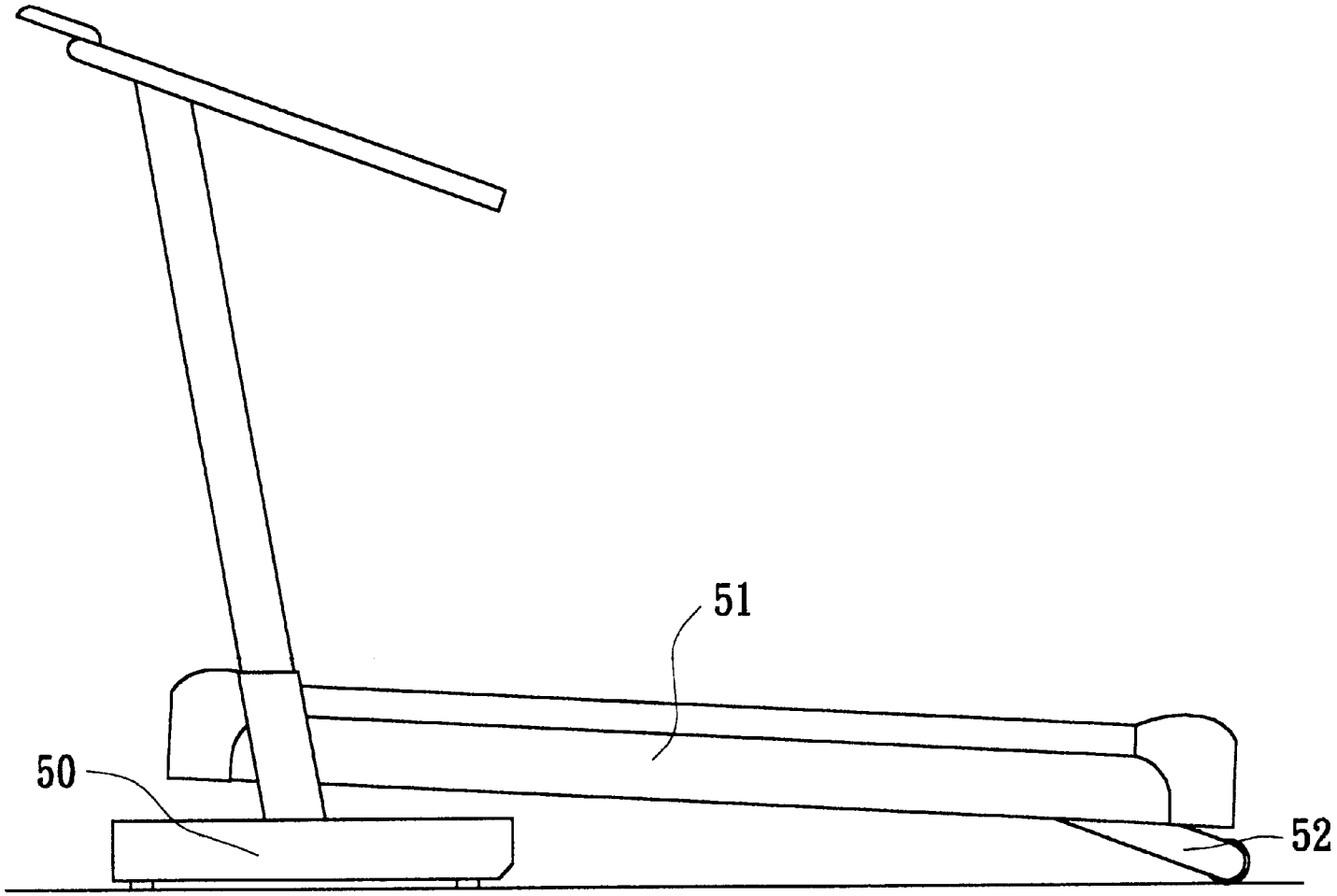
PRIOR ART FIG. 11
FIG. 11 shows that the rear side of the conventional running exerciser of FIG. 10 is inclined.
Figure 12:
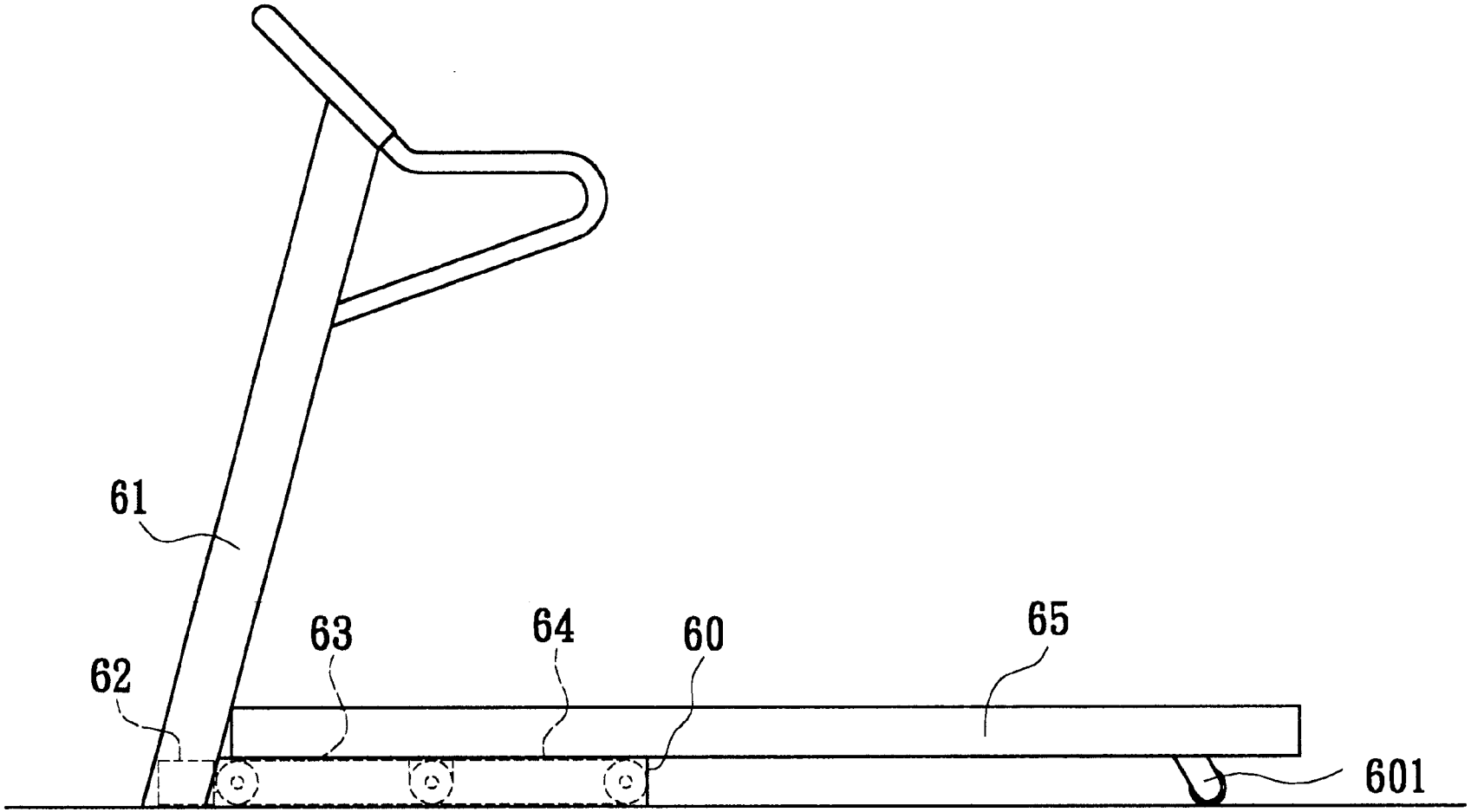
PRIOR ART FIG. 12
FIG. 12 is a side assembled view of another type of conventional running exerciser.
Figure 13:
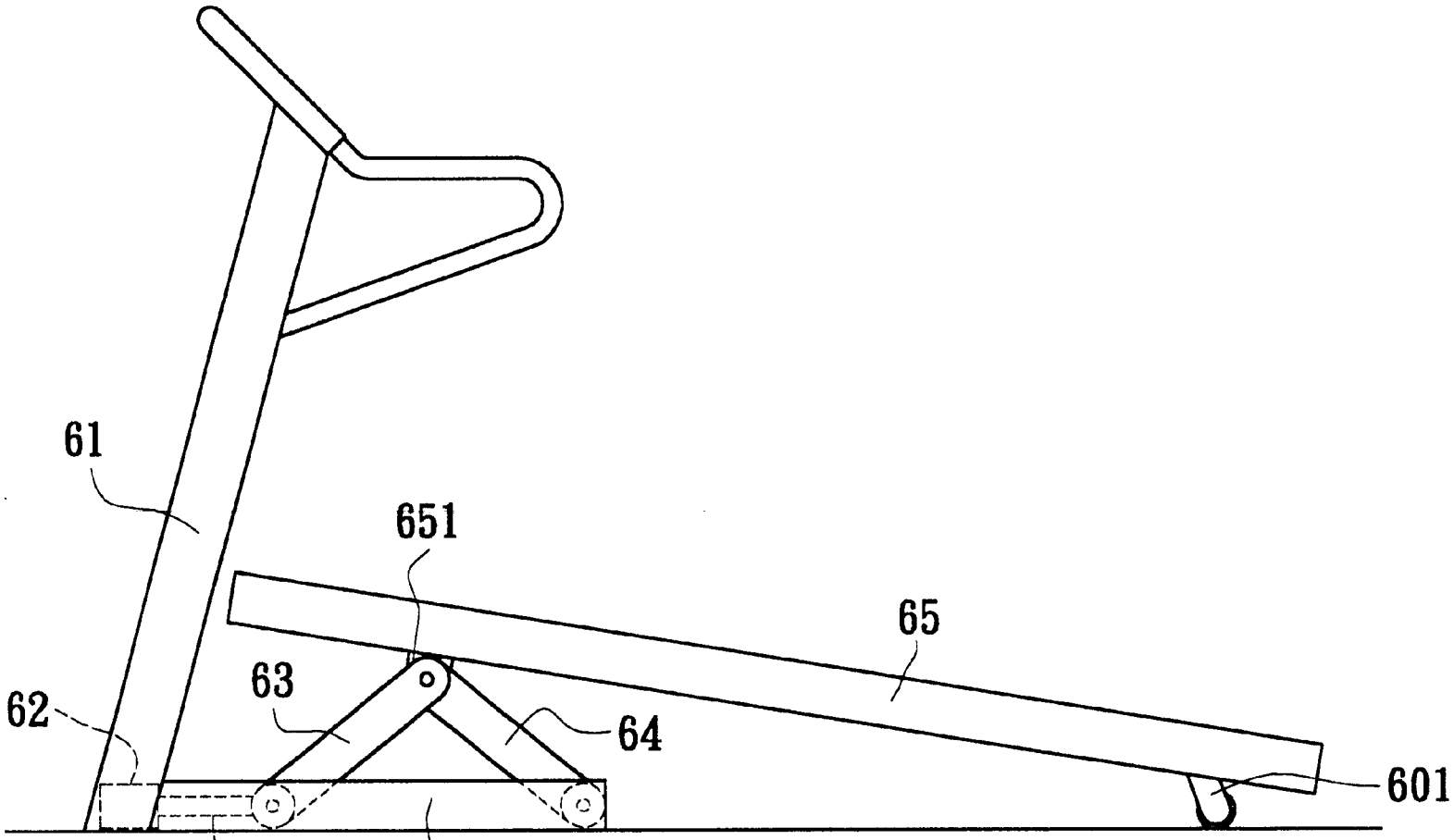
PRIOR ART FIG. 13
FIG. 13 shows that the front side of the conventional running exerciser of FIG. 12 is inclined.

Referring to FIG. 9, after finishing the running exercise, the user can directly manually turn up the rear end of the running board frame 30 about the pivot shaft 31 to a folded position where the running board frame 30 and the pivot section 291 of the linking mechanism 20 contain an angle of 90 degrees. Then the user can use a locating bolt (not shown) to lock the running board frame 30 on the rail 15 in a folded state. Accordingly, the running board frame 30 can be easily and conveniently used and folded.

The above embodiments are only used to illustrate the present invention, not intended to limit the scope thereof. Many modifications of the above embodiments can be made without departing from the spirit of the present invention.

What is claimed is:

1. A running exerciser structure comprising:

a base seat having two upright columns respectively disposed on two sides of the base seat, opposite inner sides of the two upright columns being respectively formed with two longitudinal guide channels;

a linking mechanism having a first board fixed on the base seat, a first link and a second link being respectively pivotally connected with two ends of the first board, two opposite ends of the first and second links distal from the first board being respectively pivotally connected with a first threaded bush and a second threaded bush, a threaded rod being screwed through the first and second threaded bushes, a driving motor being disposed at one end of the threaded rod, a cover body being fitted around the driving motor, the cover body having a projecting post on one side, the projecting post being received in the guide channel of one upright column, one end of the threaded rod being received in the guide channel of the other upright column, the first and second links being respectively pivotally connected with a third link and a fourth link on outer sides of the threaded bushes, the other ends of the third and fourth links being pivotally connected with a second board, a pivot section being disposed on the second board, the pivot section being formed with a through hole; and a running board frame, one side of the running board frame being pivotally connected with the second board via a pivot shaft fitted in the through hole of the second board, a running board being disposed on the running board frame, a running belt being wound around the running board and driven by a running belt motor to revolve around the running board, a supporting device being disposed under the middle of the running board frame for supporting the running board frame.

2. The running exerciser structure as claimed in claim 1, wherein a rail having a controller is disposed between top ends of the two upright columns.

3. The running exerciser structure as claimed in claim 1, wherein the supporting device is fixed under the middle of the running board frame via two lugs, a supporting wheel being pivotally connected between the two lugs.

* * * * *